United States Patent [19]

Kurtzer

[11] 3,989,924

[45] Nov. 2, 1976

[54] PORTABLE ELECTRICALLY HEATED GARMENT

[75] Inventor: Enid Baum Kurtzer, Willowdale, Canada

[73] Assignee: Lawrence Peska Associates, Inc., New York, N.Y. ; a part interest

[22] Filed: Oct. 15, 1975

[21] Appl. No.: 622,424

[52] U.S. Cl. ..... 219/211; 219/386; 219/527; 219/533

[51] Int. Cl.[2] ..... H05B 1/00

[58] Field of Search ..... 219/211, 212, 527–529, 219/533, 385–387; 128/379; 2/2.1 R

[56] References Cited

UNITED STATES PATENTS

| | | | |
|---|---|---|---|
| 1,006,415 | 10/1911 | Stubling et al. | 219/211 X |
| 1,358,509 | 11/1920 | Birkenfeld | 219/211 |
| 2,342,744 | 2/1944 | McCready | 219/211 |

*Primary Examiner*—C. L. Albritton
*Attorney, Agent, or Firm*—Jack D. Slobod

[57] ABSTRACT

An electrically heated hooded cape garment includes arm hole slits. The garment is wrapped around the body and has a power cord which is plugged into a receptacle mounted through a wall of a carrying case for the garment. Batteries within the carrying case are connected to the receptacle for supplying power to the garment.

1 Claim, 2 Drawing Figures

PORTABLE ELECTRICALLY HEATED GARMENT

FIELD OF THE INVENTION

The present invention relates generally to electric blankets. In its particular aspects, the present invention relates to an electrically heated garment which is powered by a battery within a carrying case for the garment.

BACKGROUND OF THE INVENTION

There is a need for a portable electrically heated garment adapted to be worn outdoors, for example, by a spectator at a football game. While electric blankets are well known devices for warming the body, none have an appropriate garment configuration and appropriate portability suitable for the intended use.

The prior art is already aware of U.S. Pat. Nos. 750,179 and 3,427,431.

OBJECTS OF THE INVENTION

It is an object of the present invention to provide a portable electrically heated garment and carrying case therefor which garment is configured for outdoor use, for example at football games.

It is a further object of the present invention to provide an electrically heated garment having a head warming portion.

It is yet another object of the present invention to provide an electrically heated garment for covering substantially the entire body which does not hamper the wearer's freedom of movement of his arms.

SUMMARY OF THE INVENTION

Briefly, the aforementioned and other objects of the present invention are satisfied by providing an electrically heated garment generally in the form of a cape having a main portion for wrapping about substantially the entire body from the shoulders down and a hood portion for the head. The garment is folded to be carried in a case in which are mounted batteries for supplying electrical power to the garment. A female electrical receptacle mounted through a wall of the case is electrically connected to the batteries and the garment has a power cord terminated with a plug adapted to mate with the receptacle.

Other objects, features and advantages of the present invention will become apparent upon perusal of the following detailed description of the preferred embodiment thereof when taken in conjunction with the appended drawing wherein:

FIG. 1 is a pictorial presentation of the garment and carrying case of the present invention in use; and FIG. 2 is a pictorial presentation of the garment as stored within the case.

DETAILED DESCRIPTION

Figure 1:
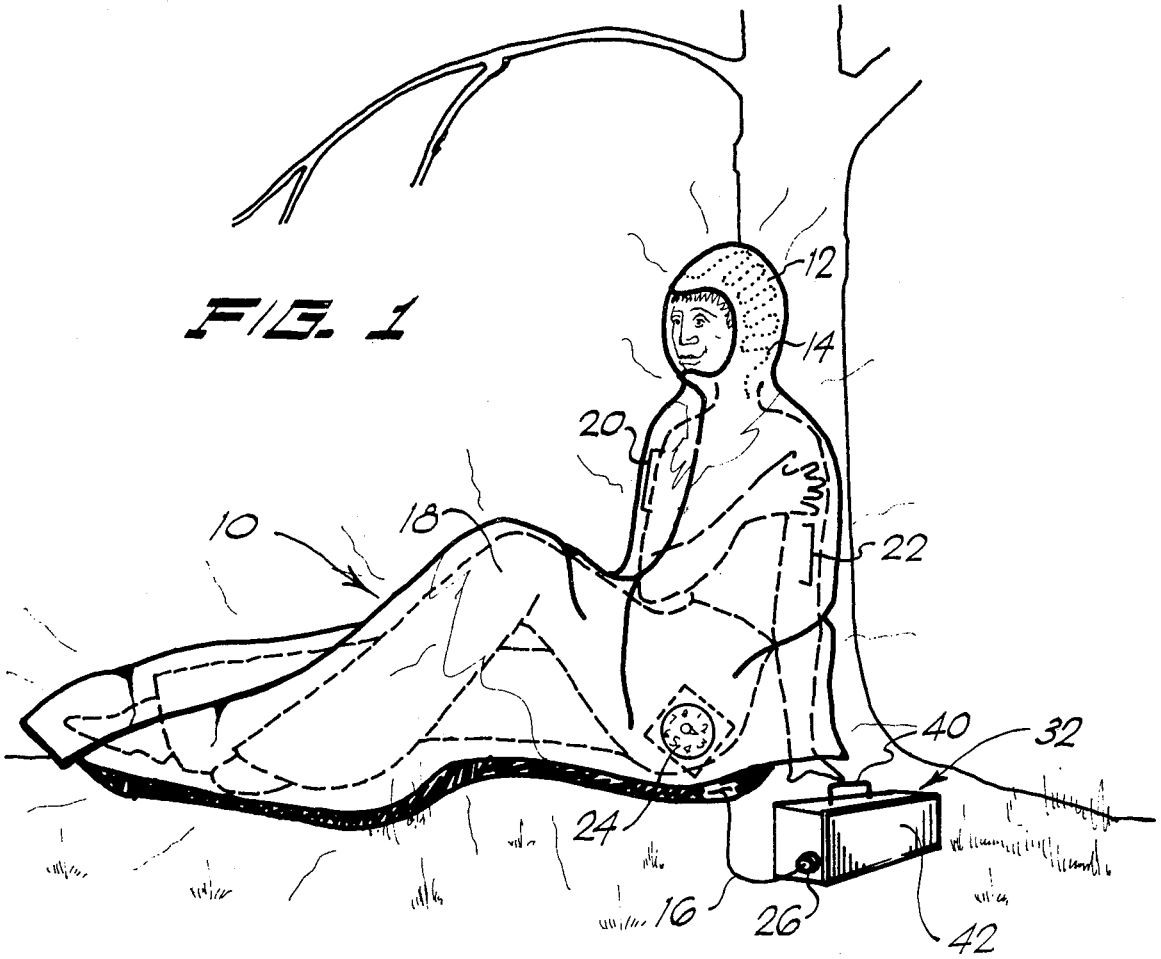
Figure 2:
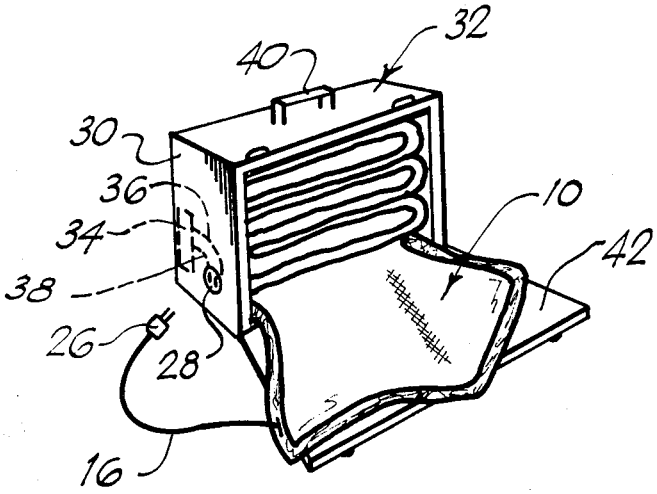

Referring to FIGS. 1 and 2 of the drawing, the electrically heated garment 10 of the present invention may generally be described as a cape having a hood 12. Meandering resistance elements 14 are distributed uniformly within the thickness of garment 10, including the hood 12, so that the entire garment may produce heat when energized via an electrical power cord 16 depending from the garment.

The garment 10 includes a main portion 18 adapted to be wrapped about the entire body of the wearer from the shoulders down. Arm hole slits 20 and 22 through main portion 18 are provided so that the wearer can have full use of his arms for such purposes as keeping score at a football game.

A thermostat control unit 24 is carried on portion 18 and is electrically connected between power cord 16 and resistance elements 14. The power cord 16 is terminated with a male plug 26 which may be engaged into a female receptacle or socket 28 mounted through a side wall 30 of a carrying case 32 in which garment 10 is adapted to be folded when not in use.

As well as providing for storing garment 10 when not in use the case 32 has a rechargeable battery power source 34 mounted therein which is electrically connected to receptacle 28 by leads 36 and 38. As best shown in FIG. 2, case 32 has an upstanding handle 40 and a hingedly mounted door 42.

While the preferred embodiment of the present invention has been described in specific detail, it should be understood that numerous modifications, additions and omissions in the details thereof are possible within the intended spirit and scope of the invention claimed herein.

What is claimed is:

1. Body warming apparatus comprising: an electrically heated cape garment having a main electrically heated portion for engagement around the body of a user; an electrically heated hood portion interconnected electrically with said main portion for engagement about the head of the user; a pair of slits in said main portion for receiving the arms of the user therethrough; said main portion having an electrical input cable terminated with a first electrical connector means; a carrying case for said garment; a battery within said carrying case; a second electrical connector means mounted through a wall of said carrying case; said first and second electrical connector means being configured for mating engagement; and said battery being connected for feeding said second electrical connector means.

* * * * *